US008483417B2

(12) United States Patent
Hüttinger

(10) Patent No.: US 8,483,417 B2
(45) Date of Patent: Jul. 9, 2013

(54) CONFIGURATION AND METHOD FOR WIRELESS DATA TRANSMISSION BETWEEN HEARING DEVICES

(75) Inventor: Simon Hüttinger, Erlangen (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 281 days.

(21) Appl. No.: 12/763,766

(22) Filed: Apr. 20, 2010

(65) Prior Publication Data

US 2010/0278367 A1 Nov. 4, 2010

Related U.S. Application Data

(60) Provisional application No. 61/175,100, filed on May 4, 2009.

(30) Foreign Application Priority Data

May 4, 2009 (DE) ..... 10 2009 019 842

(51) Int. Cl.
*H04R 25/02* (2006.01)
*H04R 25/00* (2006.01)

(52) U.S. Cl.
USPC ..... 381/315; 381/314

(58) Field of Classification Search
USPC ..... 381/315, 314, 320, 321, 328, 331, 381/312, 23.1
See application file for complete search history.

(56) References Cited

U.S. PATENT DOCUMENTS

| | | | | |
|---|---|---|---|---|
| 7,245,731 | B2 * | 7/2007 | Niederdrank et al. | 381/315 |
| 7,519,194 | B2 * | 4/2009 | Niederdrank et al. | 381/330 |
| 7,577,267 | B2 * | 8/2009 | Barthel et al. | 381/315 |
| 7,751,578 | B2 * | 7/2010 | Arz et al. | 381/315 |
| 7,844,062 | B2 * | 11/2010 | Bauml et al. | 381/312 |
| 7,953,237 | B2 * | 5/2011 | Sporer | 381/312 |
| 2006/0067550 | A1 * | 3/2006 | Puder et al. | 381/315 |
| 2007/0160242 | A1 * | 7/2007 | Cadalli et al. | 381/312 |
| 2007/0253584 | A1 * | 11/2007 | Rass | 381/312 |
| 2007/0274550 | A1 | 11/2007 | Baechler et al. | |
| 2008/0008341 | A1 * | 1/2008 | Edwards | 381/315 |
| 2008/0031478 | A1 | 2/2008 | Alber et al. | |
| 2008/0137889 | A1 | 6/2008 | Rass | |
| 2008/0159548 | A1 * | 7/2008 | Solum | 381/58 |

(Continued)

FOREIGN PATENT DOCUMENTS

| | | | |
|---|---|---|---|
| DE | 102007030745 | A1 | 1/2009 |
| DE | 102007039415 | A1 | 3/2009 |

(Continued)

*Primary Examiner* — Edgardo San Martin
(74) *Attorney, Agent, or Firm* — Laurence A. Greenberg; Werner H. Stemer; Ralph E. Locher

(57) ABSTRACT

A configuration and an associated method for the wireless transmission of data between hearing devices include an external unit which generates and emits a carrier signal, a first hearing device with a first transponder which modulates and back-scatters the carrier signal and a second hearing device with a second transponder which receives the carrier signal that is scattered backwards and forwards and modulated by the first transponder. The external unit is, for instance, a hearing device remote control. Advantageously, little or no additional energy is needed in the hearing device for the wireless data transmission. The energy for the supply of the first transponder is delivered by the carrier signal of the external unit.

14 Claims, 1 Drawing Sheet

U.S. PATENT DOCUMENTS

| | | | | |
|---|---|---|---|---|
| 2008/0175421 | A1* | 7/2008 | Chizari | 381/315 |
| 2009/0010465 | A1* | 1/2009 | Boguslavskij et al. | 381/315 |
| 2009/0028362 | A1* | 1/2009 | Frohlich et al. | 381/309 |
| 2009/0046879 | A1* | 2/2009 | Knudsen et al. | 381/315 |
| 2009/0067653 | A1* | 3/2009 | Meskens et al. | 381/315 |
| 2009/0074216 | A1* | 3/2009 | Bradford et al. | 381/315 |
| 2010/0027822 | A1* | 2/2010 | Dietz | 381/315 |
| 2010/0150386 | A1* | 6/2010 | Edgar et al. | 381/315 |
| 2010/0254554 | A1* | 10/2010 | Fusakawa et al. | 381/315 |
| 2010/0278365 | A1* | 11/2010 | Biundo Lotito et al. | 381/315 |
| 2011/0075870 | A1* | 3/2011 | Solum | 381/315 |

FOREIGN PATENT DOCUMENTS

| | | | |
|---|---|---|---|
| EP | 1883273 | A1 | 1/2008 |
| EP | 1933592 | A1 | 6/2008 |
| WO | 2007012790 | A1 | 2/2007 |

* cited by examiner

CONFIGURATION AND METHOD FOR WIRELESS DATA TRANSMISSION BETWEEN HEARING DEVICES

CROSS-REFERENCE TO RELATED APPLICATION

This application claims the priority, under 35 U.S.C. §119 (e), of U.S. Provisional Patent Application No. 61/175,100, filed May 4, 2009; this application also claims the priority, under 35 U.S.C. §119, of German Patent Application DE 10 2009 019 842.3, filed May 4, 2009; the prior applications are herewith incorporated by reference in their entirety.

BACKGROUND OF THE INVENTION

Field of the Invention

The invention relates to a configuration for wireless data transmission between hearing devices and a method for wireless data transmission between hearing devices.

Hearing devices are wearable hearing apparatuses which are used to assist the hard-of-hearing. In order to accommodate numerous individual requirements, various types of hearing devices are available, such as behind-the-ear hearing devices, hearing devices with an external receiver and in-the-ear hearing devices, for example concha hearing devices or completely-in-the-canal hearing devices. The hearing devices listed as examples are worn on the outer ear or in the auditory canal. Bone conduction hearing aids, implantable or vibrotactile hearing aids are also available on the market. The damaged hearing is thus stimulated either mechanically or electrically.

The key components of hearing devices are principally an input converter, an amplifier and an output converter. The input converter is normally a receiving transducer e.g. a microphone and/or an electromagnetic receiver, e.g. an induction coil. The output converter is most frequently realized as an electroacoustic converter e.g. a miniature loudspeaker, or as an electromechanical converter e.g. a bone conduction hearing aid. The amplifier is usually integrated into a signal processing unit. This basic configuration is illustrated in FIG. 1 using the example of a behind-the-ear hearing device 1. One or more microphones 3 for recording ambient sound are built into a hearing device housing 2 to be worn behind the ear. A signal processing unit 4, which is also integrated into the hearing device housing 2, processes and amplifies the microphone signals. The output signal for the signal processing unit 4 is transmitted to a loudspeaker or receiver 5, which outputs an acoustic signal. Sound is transmitted through a sound tube, which is affixed in the auditory canal through the use of an otoplastic, to the device wearer's eardrum. Power for the hearing device 1 and in particular for the signal processing unit 4 is supplied through the use of a battery 6 which is also integrated in the hearing device housing 2. The hearing device 1 can exchange data wirelessly, with the aid of a transmitting/receiving antenna 7 with a remote control or for binaural supply with a further hearing device.

Known devices for the wireless transmission of data in hearing devices are based on an inductive transmission at low frequencies. In that process, the transmitter in the hearing device has to provide the energy for a modulated magnetic field. Electromagnetic transmission methods with high frequencies, for instance Bluetooth, can be used for higher data transmissions. However, its energy requirement is even greater than for purely inductive devices.

SUMMARY OF THE INVENTION

It is accordingly an object of the invention to provide a configuration and a method for wireless data transmission between hearing devices, which overcome the hereinaforementioned disadvantages of the heretofore-known configurations and methods of this general type and which are energy efficient.

With the foregoing and other objects in view there is provided, in accordance with the invention, a configuration for the wireless transmission of data between hearing devices. The configuration comprises an external unit, which generates and emits a carrier signal. The configuration also includes a first hearing device with a first transponder, which modulates the carrier signal and scatters the same backwards and forwards, and a second hearing device with a second transponder, which receives the carrier signal that is back-scattered and modulated by the first transponder. The invention is advantageous in that little or no additional energy is needed in a hearing device for a wireless data transmission. The energy of the data transmission supplies the carrier signal to the external unit.

In accordance with another feature of the invention, the carrier signal may be high-frequency. This enables high data transmission ranges and transmission rates to be achieved.

In accordance with a further feature of the invention, the frequency of the carrier signal can lie in the UHF range.

In accordance with an added feature of the invention, the first transponder can be supplied with operating power exclusively by the carrier signal. This is advantageous in that the battery of a hearing device is not strained.

In accordance with an additional feature of the invention, the modulated carrier signal can advantageously contain data to be transmitted from the first to the second hearing device. This ensures an exchange of data.

In accordance with yet another feature of the invention, the first transponder can include a first antenna and the second transponder can include a second antenna. As a result, the carrier signal can be received and emitted and/or back-scattered.

In accordance with yet a further feature of the invention, the external unit can be embodied as a hearing device remote control. This has the advantage of enabling an existing external unit to be used for transmitting data between hearing devices as well.

With the objects of the invention in view, there is also provided a method for the wireless transmission of data between hearing devices. The method comprises the following steps:

- emission of a carrier signal by an external unit,
- modulation of the carrier signal by a first hearing device,
- back-scattering of the modulated carrier signal by the first hearing device and
- receiving of the back-scattered and/or forward-scattered and modulated carrier signal by a second hearing device.

In accordance with another mode of the invention, the first hearing device can be supplied with operating power by the carrier signal.

In accordance with a further mode of the method of the invention, the carrier signal can be high-frequency.

In accordance with an added mode of the invention, the method can transmit data from the first to the second hearing device by modulating the carrier signal.

In accordance with an additional mode of the invention, the carrier signal can be modulated and back-scattered and/or forward-scattered by a first transponder in the first hearing device.

In accordance with a concomitant mode of the invention, the modulation of the carrier signal can include an amplitude modulation or a phase modulation.

Other features which are considered as characteristic for the invention are set forth in the appended claims.

Although the invention is illustrated and described herein as embodied in a configuration and a method for wireless data transmission between hearing devices, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
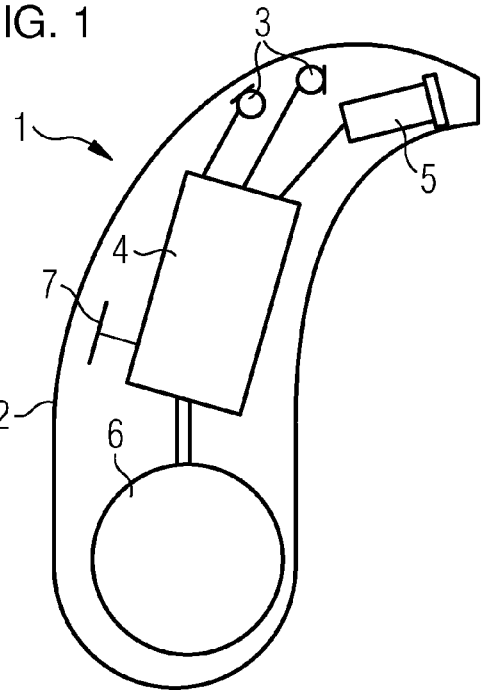
FIG. 1 is a longitudinal-sectional view of a behind-the-ear hearing device according to the prior art.
Figure 2:
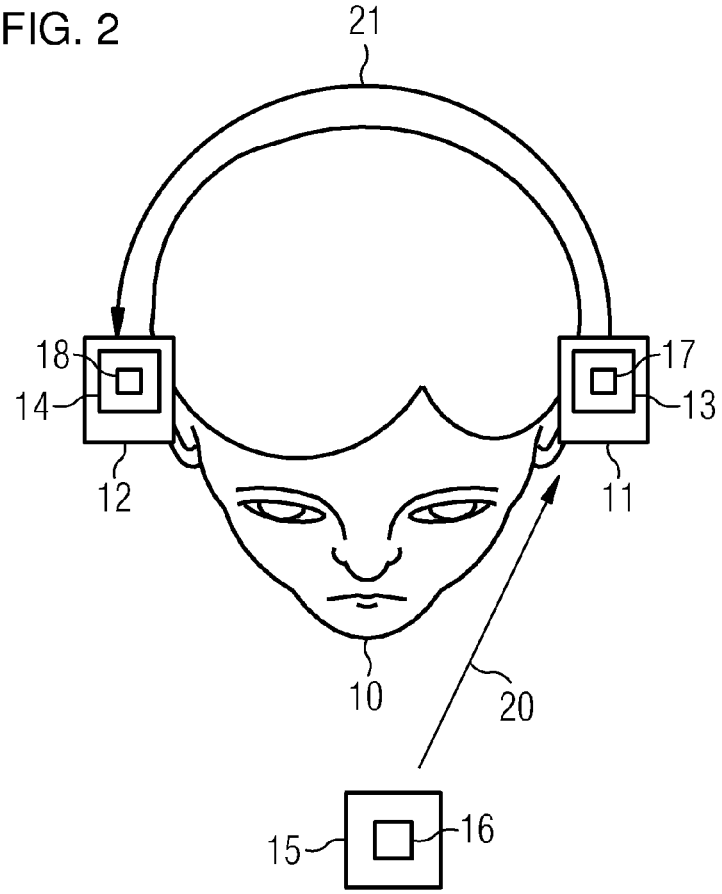
FIG. 2 is a perspective view of a head of a hearing device wearer and a block diagram of a configuration for transmitting data using a carrier signal.

Referring now to the figures of the drawings in detail and first, particularly, to FIG. 2 thereof, there is seen a configuration according to the invention in the form of a block diagram. First and second hearing devices 11, 12 are disposed on the head 10 of a hearing device wearer. The first hearing device 11 includes a first transponder 13 with a first antenna 17. The second hearing device 12 includes a second transponder 14 with a second antenna 18. An external unit 15, for instance a hearing device remote control, includes a UHF transmit unit 16, which emits a carrier signal 20 in a range of 856 to 920 MHz.

The first transponder 17 receives the carrier signal 20, modulates it with data to be transmitted to the second hearing device 12 and scatters a thus modulated carrier signal 21 backwards and/or forwards. The second transponder 14 receives the modulated, back-scattered and/or forward-scattered carrier signal 21, demodulates the same and can thus receive the transmitted data. The modulation is preferably an amplitude or phase modulation.

Since the second transponder 14 also receives the unmodulated carrier signal 20 on a direct path, the first transponder 13 must additionally encode the scattered signal 21 for a reliable transmission.

The first transponder 13 includes not only the first antenna 17 for receiving the carrier signal 20 but also a non-illustrated integrated circuit connected to the first antenna 17. The second transponder 14 includes not only the second antenna 18 for receiving the scattered and modulated carrier signal 21 but also a non-illustrated integrated circuit connected to the second antenna 18. The antennas 17 and 18 are preferably planar antennas.

The carrier signal 20 can transmit so much energy to the first transponder 13 that the first transponder 13 is supplied with operating power exclusively through the use of the carrier signal 20.

The invention is advantageous in that little or no additional energy is needed in the first hearing device 11 for a wireless transmission of data. The energy for the supply of the first transponder 13 is delivered by the carrier signal 20 of the remote control 15.

The explanations of FIG. 2 naturally similarly apply to a data transmission from the second hearing device 12 to the first hearing device 11.

The invention claimed is:

1. A configuration for wireless data transmission between hearing devices, the configuration comprising:
- an external unit generating and emitting a carrier signal;
- a first hearing device with a first transponder modulating and back-scattering the carrier signal; and
- a second hearing device with a second transponder receiving the carrier signal back-scattered and modulated by the first transponder.

2. The configuration according to claim 1, wherein the carrier signal is high-frequency.

3. The configuration according to claim 2, wherein the frequency of the carrier signal is in the UHF range.

4. The configuration according to claim 1, wherein said first transponder is configured to be supplied with operating power exclusively by the carrier signal.

5. The configuration according to claim 1, wherein the modulated carrier signal contains data to be transmitted from said first to said second hearing device.

6. The configuration according to claim 1, wherein said first transponder includes a first antenna and said second transponder includes a second antenna.

7. The configuration according to claim 1, wherein said external unit is a hearing device remote control.

8. A method for wireless data transmission between hearing devices, the method comprising the following steps:
- emitting a carrier signal with an external unit;
- modulating the carrier signal with a first hearing device;
- back-scattering the modulated carrier signal with the first hearing device; and
- receiving the back-scattered and modulated carrier signal with a second hearing device.

9. The method according to claim 8, which further comprises supplying the first hearing device with operating power by the carrier signal.

10. The method according to claim 8, wherein the carrier signal is high-frequency.

11. The method according to claim 10, wherein the frequency of the carrier signal is in the UHF range.

12. The method according to claim 8, which further comprises transmitting data from the first to the second hearing device by modulating the carrier signal.

13. The method according to claim 8, which further comprises modulating and back-scattering the carrier signal with a first transponder in the first hearing device.

14. The method according to claim 8, which further comprises carrying out the modulation of the carrier signal with an amplitude modulation or a phase modulation.

* * * * *